US008651809B2

(12) United States Patent
Ballard, Jr. et al.

(10) Patent No.: US 8,651,809 B2
(45) Date of Patent: Feb. 18, 2014

(54) APPARATUS AND METHOD FOR ALIGNING A TURBINE CASING

(75) Inventors: Henry Grady Ballard, Jr., Easley, SC (US); Ian David Wilson, Simpsonville, SC (US); Martel Alexander McCallum, Simpsonville, SC (US); Stephen Christopher Chieco, Simpsonville, SC (US); Kenneth Damon Black, Travelers Rest, SC (US); Christopher Paul Cox, Greenville, SC (US)

(73) Assignee: General Electric Company, Schenectady, NY (US)

( * ) Notice: Subject to any disclaimer, the term of this patent is extended or adjusted under 35 U.S.C. 154(b) by 710 days.

(21) Appl. No.: 12/903,466

(22) Filed: Oct. 13, 2010

(65) Prior Publication Data

US 2012/0093639 A1 Apr. 19, 2012

(51) Int. Cl.
*F01D 25/24* (2006.01)
*F04D 29/40* (2006.01)

(52) U.S. Cl.
USPC ..... 415/214.1; 415/182.1

(58) Field of Classification Search
USPC ..... 415/214.1, 213.1, 220, 215.1, 138, 139, 415/182.1
See application file for complete search history.

(56) References Cited

U.S. PATENT DOCUMENTS 2,764,266 A * 9/1956 Haworth ..... 403/22
3,062,497 A * 11/1962 Howes et al. ..... 415/126
3,584,967 A 6/1971 Zerlauth
3,592,557 A 7/1971 Haas et al.
3,628,884 A 12/1971 Mierley, Sr.
3,754,833 A 8/1973 Remberg
3,937,433 A 2/1976 Portaleoni
4,112,582 A 9/1978 Beckershoff
4,921,401 A * 5/1990 Hall et al. ..... 415/138
5,197,856 A 3/1993 Koertge et al.
5,387,082 A 2/1995 Matyscak
5,921,749 A 7/1999 McLaurin et al.
6,244,819 B1 6/2001 Voorhees
6,457,936 B1 10/2002 Leach et al.
7,260,892 B2 8/2007 Schilling et al.
2009/0185898 A1 7/2009 Kneeland et al.
2010/0080698 A1 4/2010 Flanagan

* cited by examiner

*Primary Examiner* — Nathaniel Wiehe
*Assistant Examiner* — Aaron Jagoda
(74) *Attorney, Agent, or Firm* — Dority & Manning, PA

(57) ABSTRACT

A casing includes an inner shell and an outer shell that surrounds the inner shell and comprises a plurality of inflection points. An annular flange is between the inner shell and the outer shell, and a plurality of joints attach the inner shell to the annular flange. A connector is between the annular flange and the outer shell at each of the plurality of inflection points. A method for assembling a casing includes joining a plurality of curved sections to one another to generally define an arcuate inner shell and surrounding the arcuate inner shell with an outer shell. The method further includes attaching the arcuate inner shell to an annular flange at first attachment points and connecting the annular flange to the outer shell at second attachment points spaced approximately equidistantly from the first attachment points.

20 Claims, 2 Drawing Sheets

APPARATUS AND METHOD FOR ALIGNING A TURBINE CASING

FIELD OF THE INVENTION

The present invention generally involves an apparatus and method for minimizing circularity between casings and rotating components. In particular embodiments, a multi-piece inner shell connects to an outer shell in a manner that reduces distortion and eccentricity between the inner and outer shells during transient and steady state operations.

BACKGROUND OF THE INVENTION

Turbines and other forms of commercial equipment frequently include rotating components inside or proximate to stationary components. For example, a typical gas turbine includes a compressor at the front, one or more combustors radially disposed about the middle, and a turbine at the rear. The compressor includes multiple stages of stationary vanes and rotating blades. Ambient air enters the compressor, and the stationary vanes and rotating blades progressively impart kinetic energy to the air to bring it to a highly energized state. The working fluid exits the compressor and flows to the combustors where it mixes with fuel and ignites to generate combustion gases having a high temperature and pressure. The combustion gases exit the combustors and flow through the turbine. A casing generally surrounds the turbine to contain the combustion gases as they flow through alternating stages of fixed blades or nozzles and rotating blades or buckets. The fixed blades or nozzles may be attached to the casing, and the rotating blades or buckets may be attached to a rotor. As the combustion gases flow through the nozzles, they are directed to the buckets, and thus the rotor, to create rotation and produce work.

The clearance between the casing and the rotating blades or buckets in the turbine is an important design consideration that balances efficiency and performance on the one hand with manufacturing and maintenance costs on the other hand. For example, reducing the clearance between the casing and the rotating buckets generally improves efficiency and performance of the turbine by reducing the amount of combustion gases that bypass the rotating buckets. However, reduced clearances may also result in additional manufacturing costs to achieve the reduced clearances and increased maintenance costs attributed to increased rubbing, friction, or impact between the rotating buckets and the casing. The increased maintenance costs may be a particular concern in turbines in which the rotating buckets rotate at speeds in excess of 1,000 revolutions per minute, have a relatively large mass, and include delicate aerodynamic surfaces. In addition, reduced clearances may result in excessive rubbing, friction, or impact between the rotating buckets and the casing during transient operations when the casing expands or contracts at a different rate than the rotating buckets during startup, shutdown or other variations in operation.

Conventional turbine casings generally include an outer turbine shell that holds the shrouds and nozzles. The outer turbine shell may surround one or more inner turbine shells. In some instances, each stage of rotating buckets has a separate inner turbine shell. The inner turbine shell is often split into two hemispherical shells joined or bolted together by flanges on a horizontal plane to facilitate maintenance and repair. During transient operations, temperature changes in the turbine produce axial and radial temperature gradients in the turbine casings. For example, during start up operations, the inner surfaces of the turbine shell heat up faster than the outer surfaces of the turbine shell, causing the inner material to expand faster than the outer material. As the inner material expands, the turbine shell bends to expand more horizontally than vertically, creating a slight horizontal out-of-roundness in the turbine shell. Conversely, during shutdown operations, the inner turbine shell cools down faster than the outer turbine shell, and the bolted flanges allow the inner turbine shell to contract more horizontally than vertically, again creating a slight vertical out-of-roundness in the inner turbine shell. Therefore, both startup and shutdown operations produce out-of-round conditions in the inner turbine shell that change the clearance between the inner turbine shell and the rotating buckets, thus affecting the operation of the turbine.

Various systems and methods are known in the art for controlling or maintaining a consistent clearance between the inner shells and rotating buckets. For example, U.S. Pat. No. 6,126,390 describes a system in which airflow from the compressor or combustor is metered to the turbine casing to heat or cool the turbine casing, depending on the temperature of the incoming air. In addition, U.S. patent publication 2009/0185898, assigned to the same assignee as the present invention, describes a system that includes an inner turbine shell having false flanges at the top and bottom to reduce eccentricities caused by transient operations. However, additional improvements in the design of casings to reduce transient eccentricities over a wide range of operating conditions would be useful.

BRIEF DESCRIPTION OF THE INVENTION

Aspects and advantages of the invention are set forth below in the following description, or may be obvious from the description, or may be learned through practice of the invention.

One embodiment of the present invention is a casing that includes a first inner shell having a plurality of curved sections that abut one another to generally define an arcuate shape. An outer shell surrounds the first inner shell and comprises a plurality of inflection points, and an annular flange is between the first inner shell and the outer shell. A plurality of joints have a first end and a second end, and the first end of each of the plurality of joints is attached to at least two of the curved sections of the first inner shell, and the second end of each of the plurality of joints is attached to the annular flange. A connector is between the annular flange and the outer shell at each of the plurality of inflection points.

Another embodiment of the present invention is a casing that includes a first inner shell. The first inner shell comprises a plurality of curved sections that abut one another to generally define an arcuate shape. An outer shell surrounds the first inner shell. An annular flange is located between the first inner shell and the outer shell. A plurality of joints have a first end and a second end. The first end of each of the plurality of joints is attached to at least one of the curved sections of the first inner shell, and the second end of each of the plurality of joints is attached to the annular flange. A plurality of means for connecting the annular flange to the outer shell are spaced approximately equidistantly from each of the plurality of joints.

Embodiments of the present invention also include a method for assembling a casing. The method includes joining a plurality of curved sections to one another to generally define a first arcuate inner shell and surrounding the first arcuate inner shell with an outer shell. The method further includes attaching the first arcuate inner shell to an annular flange at a plurality of first attachment points and connecting the annular flange to the outer shell at a plurality of second attachment points, wherein the plurality of second attachment points are spaced approximately equidistantly from the plurality of first attachment points.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
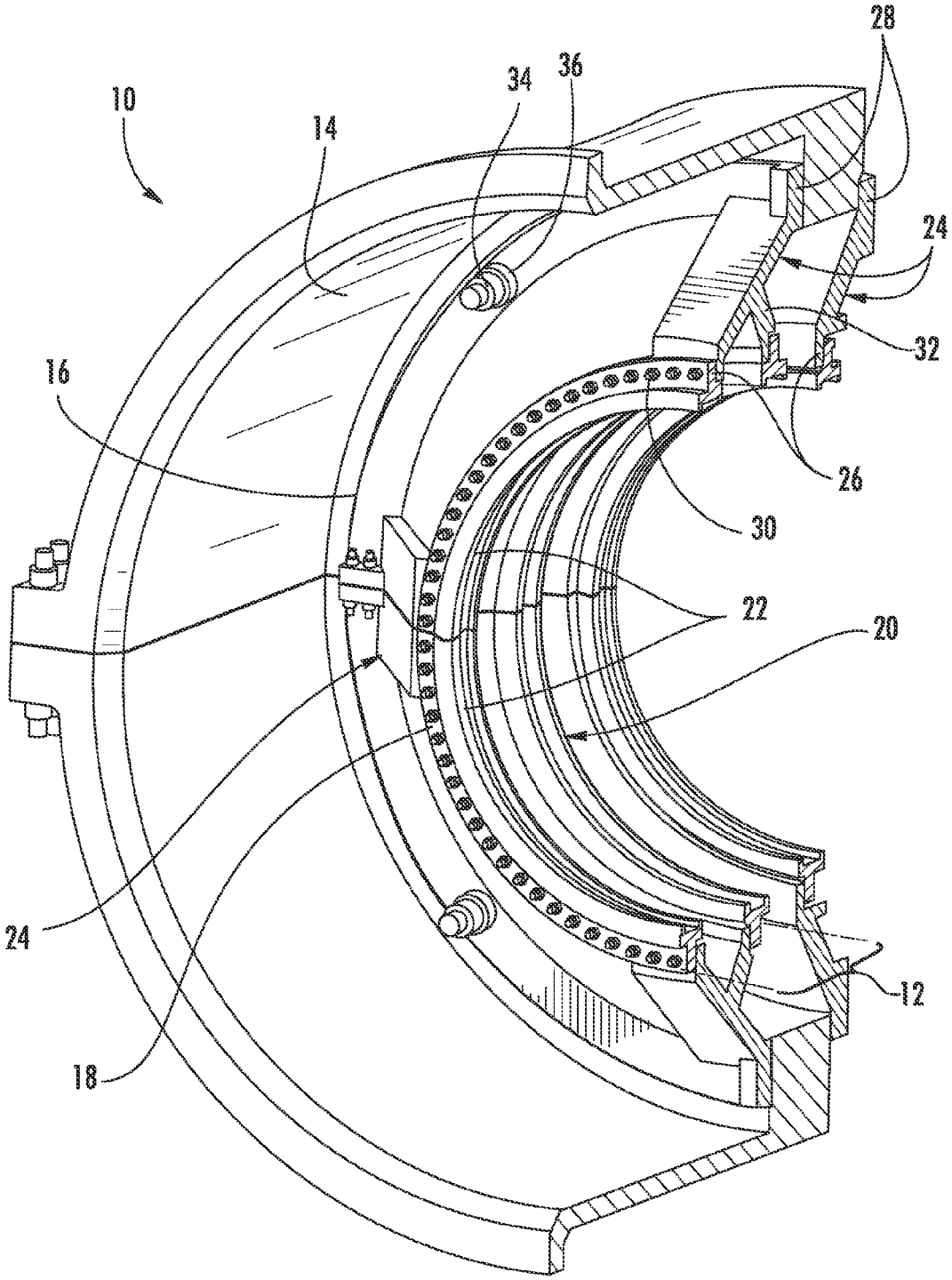
FIG. 1 is a cross-sectional perspective view of a turbine casing according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof For instance, features illustrated or described as part of one embodiment may be used on another embodiment to yield a still further embodiment. Thus, it is intended that the present invention covers such modifications and variations as come within the scope of the appended claims and their equivalents.

Figure 2:
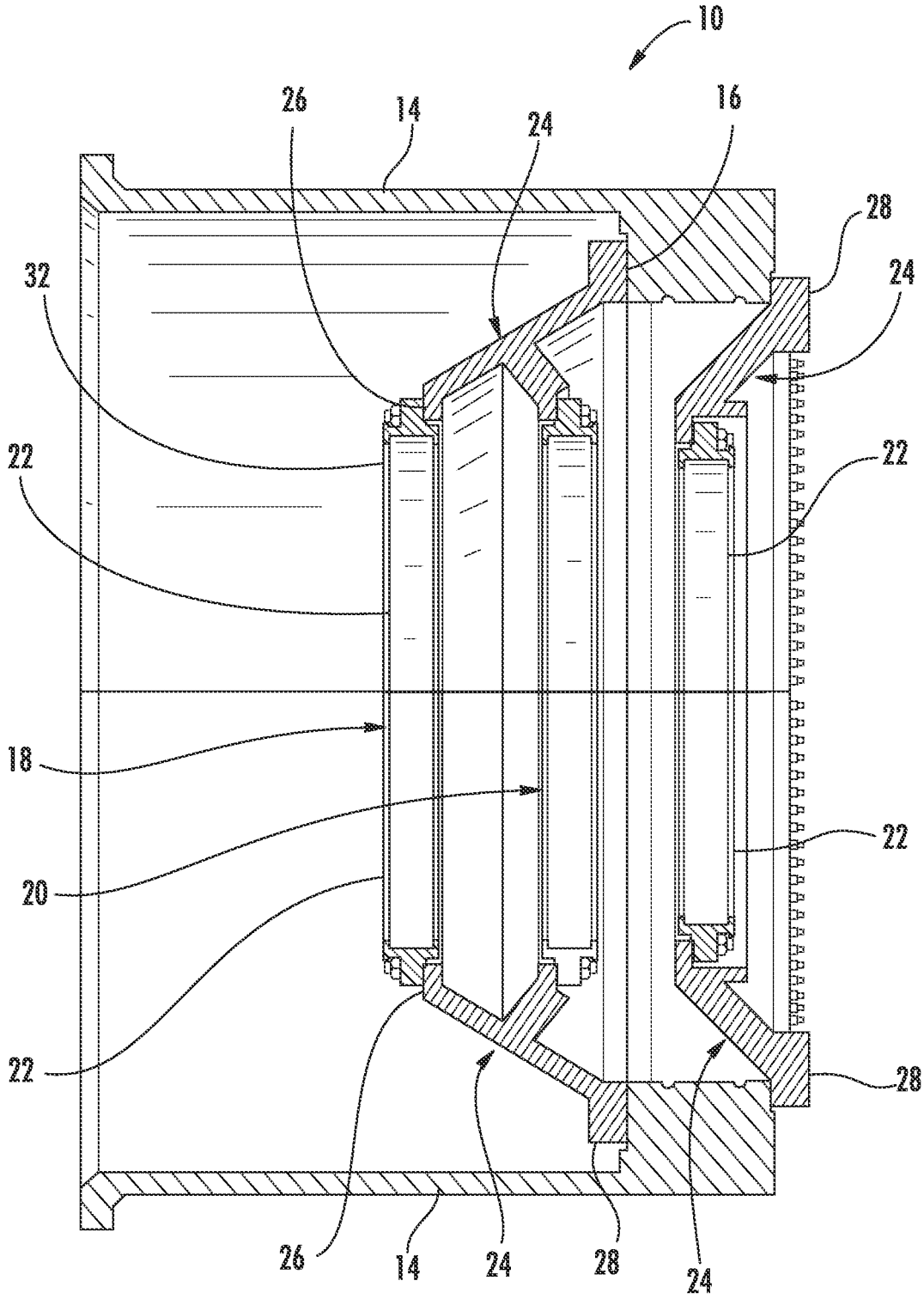
FIG. 2 is a cross-sectional side view of the turbine casing shown in FIG. 1.

FIG. 1 provides a cross-sectional perspective view of a casing 10 according to one embodiment of the present invention, and FIG. 2 provides a partial cross-sectional perspective view of the casing 10 shown in FIG. 1. Although embodiments of the present invention will be described in the context of a generic casing surrounding a rotating component, one of ordinary skill in the art will readily appreciate that embodiments of the present invention may be used as a casing for a compressor, turbine, or any equipment having rotating components therein, and embodiments of the present invention are not limited to any particular rotating component unless specifically recited in the claims. The casing 10 generally includes one or more inner shells 12, an outer shell 14, and an annular flange 16. The one or more inner shells 12, outer shell 14, and annular flange 16 are typically fabricated from alloys, superalloys, coated ceramics, or other material capable of withstanding temperatures associated with the particular rotating component. For example, a casing for a turbine in a gas turbine system would be fabricated from materials capable of withstanding temperatures associated with combustion gases flowing through the gas turbine system.

The one or more inner shells 12 are generally arcuate or circular in shape to conform to and surround the particular rotating component. For example, a single inner turbine shell may be used to surround all of the stages of rotating buckets, or a first inner turbine shell 18 may be used to surround a first stage of rotating buckets, with a second inner turbine shell 20 surrounding a second stage of rotating buckets, and so forth. The inner shells 12 generally comprise a plurality of curved sections 22 that abut one another to generally define an arcuate or circular shape. As used herein, "abut" means that the curved sections 22 are arranged or assembled end to end. The curved sections 22 of the inner shells 12 may have different lengths that combine to generally surround the sequential stages of rotating buckets, or the curved sections 22 of the inner shells 12 may be approximately equal in length. For example, as shown in FIG. 1, each of the four curved sections 22 of the inner shells 12 is approximately equal in length and extends approximately 90 degrees around the arcuate shape. Alternate embodiments within the scope of the present invention may include more or fewer than four curved sections 22 in each inner shell 12. For example, in a particular embodiment, the inner shell 12 may include two curved sections 22, with each curved section 22 extending approximately 180 degrees around the arcuate shape. Similarly, in another particular embodiment, the inner shell 12 may include six curved sections 22, with each curved section 22 extending approximately 60 degrees around the arcuate shape. One of ordinary skill in the art will readily appreciate that many combinations of the number and the length of each curved section 22 may be selected, and the number or length of the curved sections 22 is not a limitation of the present invention unless specifically recited in the claims.

The outer shell 14 generally surrounds the one or more inner shells 12 and together form the casing 10. In this manner, the inner shells 12 generally conform to the outer perimeter of the rotating component, and the outer shell 14 provides an enclosure around the rotating component.

As shown in FIGS. 1 and 2, the annular flange 16 is generally located between the inner shells 12 and the outer shell 14 and extends around the rotating component. As such, the annular flange 16 provides a suitable structure for attaching the inner shells 12 to the outer shell 14 to facilitate maintaining the inner shells 12 concentric with the outer shell 14. Particular embodiments may include a separate annular flange 16 for each inner shell 12, while in other particular embodiments a single annular flange 16 may be used to attach multiple inner shells 12 to the outer shell 14.

As shown in FIGS. 1 and 2, a plurality of joints 24 may be used to attach the inner shells 12 to the annular flange 16. Each of the plurality of joints 24 generally includes a first end 26 and a second end 28. The first end 26 of each of the plurality of joints 24 is attached to one or more of the curved sections 22 of the inner shell 12. For example, as shown in FIGS. 1 and 2, the first end 26 of each of the plurality of joints 24 may be attached to adjacent ends of two of the curved sections 22 of the first inner shell 12. In this manner, each of the plurality of joints 24 also functions to attach or connect the curved sections 22 to one another. In alternate embodiments, the first end 26 of each of the plurality of joints 24 may be attached to a single curved section 22 of the inner shell 12, and additional or separate clamps, flanges, bolts, pins, welds, or similar structures may be used to attach or connect the curved sections 22 to one another.

The second end 28 of each of the plurality of joints 24 is attached to the annular flange 16, thus forming a connection between the curved sections 22 of the inner shell 12 and the annular flange 16. Bolts 30, pins, clamps, welds, or similar mechanical devices known to one of ordinary skill in the art may be used to attach the first and second ends 26, 28 of each of the plurality of joints 24 to the curved sections 22 of the inner shell 12 and annular flange 16, respectively. As shown in FIGS. 1 and 2, each of the plurality of joints 24 may be spaced approximately equidistantly from one another. For example, the embodiment illustrated in FIGS. 1 and 2 includes four joints connecting the inner shells 12 to the annular flange 16, with each joint 24 located approximately every 90 degrees around the inner shells 12 and annular flange 24. Alternate embodiments within the scope of the present invention may include more or fewer than four joints 24. For example, in a particular embodiment, two joints 24 may be used to connect the inner shell 12 to the annular flange, with each joint 24 located approximately every 180 degrees around the inner shell 12 and annular flange 16. Similarly, in another particular embodiment, six joints 24 may be used to connect the inner shell 12 to the annular flange 16, with each joint 24 located approximately every 60 degrees around the inner shell 12 and annular flange 16. One of ordinary skill in the art will readily appreciate that many combinations of the number and location of joints 24 may be selected, and the number or location of the joints 24 is not a limitation of the present invention unless specifically recited in the claims.

The plurality of joints 24 may further include a branch 32 extending from approximately the midpoint between the first and 26 and second end 28. For example, for the particular embodiment of the casing 10 shown in FIGS. 1 and 2, the branch 32 from the plurality of joints 24 is attached to the second inner shell 20. In this manner, the plurality of joints 24 may be used to attach multiple inner shells 12 to one flange 16.

The casing 10 further includes a plurality of means for connecting the annular flange 16 to the outer shell 14. The structure for each of the means for connecting the annular flange 16 to the outer shell 14 may be a connector 34, such as a bolt, pin, clamp, adhesive, or equivalent mechanical or chemical structure known to one of ordinary skill in the art. Each of the plurality of means for connecting the annular flange 16 to the outer shell 14 may be located approximately coincidental with inflection points on the outer shell 14. As used herein, the inflection points on the outer shell 14 are defined to be the points on the outer shell 14 that move the shortest distance during expansion and contraction of the outer shell 14. One of ordinary skill in the art can readily determine the location of the inflection points on any outer shell through mathematical models and/or operational testing. For example, an outer shell comprising two halves connected on a horizontal axis has two inflection points on each half located at approximately 45° above and below the horizontal axis. In the case of an outer shell comprising two halves connected on a horizontal axis and an inner shell comprising 4 curved sections joined to one another at 0°, 90°, 180°, and 270°, the inflection points, and thus the location of the means for connecting the annular flange 16 to the outer shell 14, are approximately equidistantly spaced from each of the plurality of joints 24.

For example, in the embodiment illustrated in FIGS. 1 and 2, the means for connecting the annular flange 16 to the outer shell 14 is simply a fitted pin 34 extending through a borehole 36 in the annular flange 16. As further shown in FIGS. 1 and 2, each pin 34 is located approximately midway between adjacent joints 24, at approximately 45°, 135°, 225°, and 315° around the annular flange 16. As a result, each pin 34 is spaced approximately equidistantly from each of the joints 24.

One of ordinary skill in the art will readily appreciate that the structure previously described with respect to FIGS. 1 and 2 provides a method for assembling a casing 10. The method generally includes joining the plurality of curved sections 22 to one another to generally define the first arcuate inner shell 18 and surrounding the first arcuate inner shell 18 with the outer shell 14. The method further includes attaching the first arcuate inner shell 18 to the annular flange 16 at a plurality of first attachment points 24. In addition, the method includes connecting the annular flange 16 to the outer shell 14 at a plurality of second attachment points 34, wherein the second attachment points 34 are spaced approximately equidistantly from the first attachment points 24. In particular embodiments, the first arcuate inner shell 18 may be connected to the annular flange 16 at first attachment points 24 that are spaced approximately equidistantly from one another. Moreover, the method may include attaching the second arcuate inner shell 22 to the annular flange 16 at a plurality of third attachment points 32.

Empirical testing and computer-generated models indicate that various embodiments of the present invention may have one or more benefits over existing casings. For example, replacing false flanges with the plurality of joints 24 spaced approximately equidistantly around the inner shells 12 may reduce out-of-roundness in the inner shells 12 during transient and steady-state operations. In addition, attaching the annular flange 16 to the outer shell 14 with connectors 34 spaced approximately equidistantly from the plurality of joints 24 may further reduce the transmission of any out-of-roundness from the inner shells 12 to the outer shell 14. Lastly, the annular flange 16 and connectors 34 provide a convenient and reliable structure for ensuring the inner shells 12 are concentrically attached to the outer shell 14 during assembly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A casing comprising:

a first inner shell, wherein the first inner shell comprises a plurality of curved sections that abut one another to generally define an arcuate shape;

an outer shell surrounding the first inner shell wherein the outer shell comprises a plurality of inflection points;

an annular flange between the first inner shell and the outer shell;

a plurality of joints, wherein each of the plurality of joints has a first end and a second end extending radially outward from the first end and the first end of each of the plurality of joints is attached to at least two of the curved sections of the first inner shell and the second end of each of the plurality of joints is attached to the annular flange by a mechanical device; and a connector between the annular flange and the outer shell at each of the plurality of inflection points.

2. The casing as in claim 1, wherein each connector is spaced approximately equidistantly from at least two joints.

3. The casing as in claim 1, wherein the inflection points are located approximately 45° above and below a horizontal axis of the outer shell.

4. The casing as in claim 1, wherein the first inner shell comprises four curved sections and each of the four curved sections extends approximately 90 degrees around the arcuate shape.

5. The casing as in claim 1, wherein each of the plurality of joints is spaced approximately equidistantly from one another.

6. The casing as in claim 1, wherein each connector comprises a bolted connection between the annular flange and the outer shell.

7. The casing as in claim 1, wherein each connector comprises a pinned connection between the annular flange and the outer shell.

8. The casing as in claim 1, further comprising a second inner shell adjacent to the first inner shell.

9. The casing as in claim 8, wherein the second inner shell is connected to each of the plurality of joints between the first end and the second end of each of the plurality of joints.

10. A casing comprising:

a first inner shell, wherein the first inner shell comprises a plurality of curved sections that abut one another to generally define an arcuate shape;

an outer shell surrounding the first inner shell;

an annular flange between the first inner shell and the outer shell;

a plurality of joints, wherein each of the plurality of joints has a first end and a second end extending radially outward from the first end and the first end of each of the plurality of joints is attached to at least one of the curved sections of the first inner shell and the second end of each of the plurality of joints is attached to the annular flange by a mechanical device; and a plurality of means for connecting the annular flange to the outer shell, wherein each of the plurality of means for connecting the annular flange to the outer shell is spaced approximately equidistantly from each of the plurality of joints.

11. The casing as in claim 10, wherein each of the plurality of curved sections is approximately equal in length.

12. The casing as in claim 10, wherein the first inner shell comprises four curved sections and each of the four curved sections extends approximately 90 degrees around the arcuate shape.

13. The casing as in claim 10, wherein each of the plurality of joints is spaced approximately equidistantly from one another.

14. The casing as in claim 10, wherein the first end of each of the plurality of joints is attached to at least two of the curved sections of the first inner shell.

15. The casing as in claim 10, further comprising a second inner shell adjacent to the first inner shell.

16. The casing as in claim 15, wherein the second inner shell is connected to each of the plurality of joints between the first end and the second end of each of the plurality of joints.

17. The casing as in claim 15, wherein the second shell is connected to each of the plurality of joints approximately midway between the first end and the second end of each of the plurality of joints.

18. A casing comprising:

a first inner shell, wherein the first inner shell comprises a plurality of curved sections that abut one another to generally define an arcuate shape;

an outer shell surrounding the first inner shell wherein the outer shell comprises a plurality of nflection points;

an annular flange between the first inner shell and the outer shell;

a plurality of joints, wherein each of the plurality of joints has a first end and a second end and the first end of each of the plurality of joints is attached to at least two of the curved sections of the first inner shell and the second end of each of the plurality of joints is attached to the annular flange, and wherein each of the plurality of joints further comprises a branch extending from approximately a midpoint between the first end and the second end; and a connector between the annular flange and the outer shell at each of the plurality of inflection points.

19. The casing as in claim 18, farther comprising a second inner shell adjacent to the first inner shell.

20. The casing as in claim 19, wherein the second inner shell is connected to the branch of each of the plurality of joints.

* * * * *